US011745368B2

(12) United States Patent
Solerio et al.

(10) Patent No.: US 11,745,368 B2
(45) Date of Patent: Sep. 5, 2023

(54) PERSONAL CARE DEVICE HAVING A MAIN FUNCTIONAL UNIT AND AN ANCILLARY FUNCTIONAL UNIT

(71) Applicant: KONINKLIJKE PHILIPS N.V., Eindhoven (NL)

(72) Inventors: Daniele Solerio, Groningen (NL); Michel Van Es, Groningen (NL); Gerard Johannes Pieter Nijsse, Bodegraven (NL); Aditya Mehendale, Waarle (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/779,163

(22) PCT Filed: Nov. 24, 2020

(86) PCT No.: PCT/EP2020/083107
§ 371 (c)(1),
(2) Date: May 24, 2022

(87) PCT Pub. No.: WO2021/110465
PCT Pub. Date: Jun. 10, 2021

(65) Prior Publication Data

US 2022/0402151 A1 Dec. 22, 2022

(30) Foreign Application Priority Data

Dec. 4, 2019 (EP) ..... 19213693

(51) Int. Cl.
*B26B 19/10* (2006.01)
*B26B 19/26* (2006.01)

(52) U.S. Cl.
CPC ..... *B26B 19/105* (2013.01); *B26B 19/26* (2013.01)

(58) Field of Classification Search
CPC ..... B26B 19/105; B26B 19/10; B26B 19/102; B26B 19/107; B26B 19/48; B26B 19/26; B26B 19/265
(Continued)

(56) References Cited

U.S. PATENT DOCUMENTS 3,364,569 A 1/1968 Dokos
3,911,572 A 10/1975 Czerner
(Continued)

FOREIGN PATENT DOCUMENTS

EP 2208588 A1 7/2010
EP 2815856 A1 12/2014
(Continued)

OTHER PUBLICATIONS

International Search Report and Written Opinion dated Jan. 15, 2021 for International Application No. PCT/EP2020/083107 filed Nov. 24, 2020.

*Primary Examiner* — Phong H Nguyen

(57) ABSTRACT

A personal care device has a main functional unit and an ancillary functional unit which is displaced between a non-operational position and an operational position using a biasing arrangement. A magnet arrangement is used to exert a magnetic holding on the ancillary functional unit in the operational position. This provides a stable support of the ancillary functional unit in the operational position without requiring a strong biasing arrangement.

13 Claims, 5 Drawing Sheets

(58) Field of Classification Search
USPC ..... 30/34.1, 34.05
See application file for complete search history.

(56) References Cited

U.S. PATENT DOCUMENTS

| | | | | |
|---|---|---|---|---|
| 3,991,464 | A | 11/1976 | Ihasz | |
| 4,408,392 | A | 10/1983 | Naimer | |
| 2009/0019706 | A1 | 1/2009 | Werner | |
| 2015/0174774 | A1* | 6/2015 | Hodgson | B26B 21/4018 30/34.2 |
| 2018/0281212 | A1* | 10/2018 | Chen | B26B 19/382 |
| 2020/0215682 | A1* | 7/2020 | Cafasso | B25G 3/12 |

FOREIGN PATENT DOCUMENTS

| | | | |
|---|---|---|---|
| EP | 3326769 | A1 | 5/2018 |
| JP | 2014033770 | A | 2/2014 |
| JP | 2018526076 | A | 9/2018 |

* cited by examiner

PERSONAL CARE DEVICE HAVING A MAIN FUNCTIONAL UNIT AND AN ANCILLARY FUNCTIONAL UNIT

CROSS REFERENCE TO RELATED APPLICATIONS

This application is the U.S. National Phase application under 35 U.S.C. § 371 of International Application No. PCT/EP2020/083107 filed Nov. 24, 2020, which claims the benefit of European Patent Application Number 19213693.5 filed Dec. 4, 2019. These applications are hereby incorporated by reference herein.

FIELD OF THE INVENTION

This invention relates to personal care devices having a main functional unit and an ancillary functional unit, and in particular in which the ancillary functional unit may be deployed into an operational position and retained in a non-operational position.

BACKGROUND OF THE INVENTION

Personal care devices may have various different grooming functions to be carried out, such as shaving, brushing, epilating, hair trimming, skin abrading, etc.

Often, a personal care device is designed to enable two or more of these functions to be performed by a single device. A common example is an electric shaver with a so-called pop-up trimmer. The pop-up trimmer is an integrated trimmer that springs from a non-operational position into an operational position relative to the shaver body through a simple spring and latch mechanism.

Other mechanisms may be used such as a sliding mechanism instead of a pop-up mechanism.

These types of mechanism are very well known and widely used. The mechanisms allow the trimmer to be folded or slid back from its operational position into a recessed position in the shaver body by applying a small force until it latches into its recessed position, in which the trimmer is non-operational.

The pop-up mechanism is very simple, but it has a drawback that the force required to fold back the trimmer into the non-operational position is very low. This may result in an instable operational position of the trimmer, which may give a flimsy or low quality or low price impression.

It has been proposed to improve the mechanism by adding cantilevers, extra springs or similar components to better support the trimmer to improve the touch and feel. However, these extra components are generally cumbersome and their presence requires an increase in dimensions. The increase in dimensions results in an increase in size for the entire shaver. Extra mechanisms (e.g. cantilevers, etc.) increase the radial dimension of the shaver around the grip area, decreasing the ergonomics of the entire appliance. It is instead desired to keep the trimmer unit as compact as possible, and thereby maintain as much as possible design freedom for the rest of the device.

It would be possible to make a more stable trimmer without using extra components and without needing extra space, by increasing the stiffness of the spring used to bias the trimmer into the operational position. However the closing effort could then be uncomfortable, with high forces needed to reach the non-operational position. This approach would also lead to much higher stresses, which may result in a system failure.

EP 3 326 769 A1 discloses a multifunctional electric hair trimmer which comprises a casing in which a driving module is provided. The hair trimmer comprises a nose hair trimmer blade set, a hair clipper blade set and a shaver blade set. Each of the three blade sets is provided on a separate support which is hinged on the casing. The hinge points of the supports are successively arranged along the direction of extension of the output shaft of the driving module. Each blade set can be individually turned from a housed position inside the casing into an operating position, wherein the blade set is coupled to the output shaft of the driving module by means of a clutch coupling. In an embodiment, the clutch coupling is a magnetic coupling comprising an active pole mounted on the output shaft of the driving module and a passive pole mounted on the input shaft of each of the blade sets.

There remains a need for an improved mechanism for deploying an ancillary functional unit of a personal care device from its non-operational position into its operational position relative to the main body of the personal care device. A pop-up trimmer of an electric shaver is one example, but the same issues arise with other types of ancillary functional units of an electric shaver or of another type of personal care device which are to be deployed from a non-operational position into an operational position.

SUMMARY OF THE INVENTION

The invention is defined by the claims.

According to the invention, there is provided a personal care device comprising:

a main body;

a main functional unit supported by the main body;

an ancillary functional unit supported by the main body and comprising a treatment head; and a coupling structure by means of which the ancillary functional unit is permanently connected to the main body, wherein the coupling structure:

is configured to allow displacement of the ancillary functional unit relative to the main body from a non-operational position to an operational position; and comprises a biasing arrangement configured to exert a biasing force on the ancillary functional unit to displace the ancillary functional unit from the non-operational position towards the operational position and to hold the ancillary functional unit in the operational position, wherein the coupling structure further comprises a magnet arrangement configured to exert, in addition to the biasing force of the biasing arrangement, a magnetic holding force on the ancillary functional unit in the operational position of the ancillary functional unit, for retaining the ancillary functional unit in the operational position.

In accordance with the invention, the personal care device has an ancillary functional unit which is deployed from its non-operational position into its operational position relative to the main body using the biasing force of a biasing arrangement. The biasing arrangement provides a biasing force which resists the return of the ancillary functional unit to the non-operational position and, thus, holds the ancillary functional unit in the operational position. To provide a sufficient force to keep the ancillary functional unit in the operational (deployed) position during use, a magnet arrangement provides an additional magnetic holding force on the ancillary functional unit in the operational position, i.e. in addition to the biasing force of the biasing arrangement. This avoids the need to increase the biasing force delivered by the biasing arrangement. Thus, the biasing arrangement only needs to provide sufficient biasing force to deploy the ancillary functional unit from the non-operational position into the operational position. The biasing arrangement can thus be small, compact and low cost. The magnetic holding force exerted on the ancillary functional unit will be substantial only when the ancillary functional unit is in or very close to the operational position. Therefore, in order to push the ancillary functional unit back into its non-operational position, the user needs to apply only a relatively low pushing force, equal to or slightly higher than the low biasing force of the biasing arrangement, during the main part of the return path from the operational to the non-operational position.

The magnet arrangement gives another functional benefit. When using the ancillary functional unit in its operational position, e.g. as a pop-up trimmer for trimming the sideburns, the ancillary functional unit is more stable and, thereby, suitable for example for a precise cutting process. Without the magnet arrangement, the ancillary functional unit may easily fold while being used, leading to an imprecise cutting process.

The magnet arrangement does however not fully lock the ancillary functional unit in its operational position. If the ancillary functional unit would be fully locked in its operational position, the ancillary functional unit might be damaged in case the personal care device is dropped on the floor. In practice, when a force of more than a predefined threshold (e.g. 2.5N) is applied on the ancillary functional unit, the magnet arrangement will disengage and the ancillary functional unit will move out of its operational position.

The coupling structure for example defines a pivotal axis about which the ancillary functional unit is rotatable relative to the main body from the non-operational position to the operational position.

Thus, the ancillary functional unit pivots into the operational and non-operational positions.

The non-operational position is for example a retracted position in which the ancillary functional unit is at least partially recessed into the main body, and the operational position is for example an extended position in which the ancillary functional unit projects from the main body. Thus, the ancillary functional unit projects outwardly from the main body when in use but collapses into or against the main body when not in use.

The ancillary functional unit for example comprises a supporting member configured to permanently support the treatment head, wherein the magnet arrangement is configured to exert the magnetic holding force on the supporting member. The supporting member is for example a plastic support plate comprising a ferrous metal element for interaction with the magnet arrangement.

The coupling structure for example comprises:

a latching mechanism configured to latch the ancillary functional unit in the non-operational position; and a release mechanism configured to release the latching mechanism such that the ancillary functional unit is enabled to be displaced from the non-operational position to the operational position by the biasing force of the biasing arrangement.

In this example, when the latching mechanism is released, the ancillary functional unit is automatically driven to the operational position by the biasing force of the biasing arrangement. The user only needs to operate the release mechanism, which may be a simple button or slider.

The biasing arrangement for example comprises a mechanical spring. It may be a torsion spring for driving a rotation of the ancillary functional unit about a pivot axis.

In a first set of examples, the magnet arrangement comprises a first portion mounted to the ancillary functional unit and a second portion mounted to the main body and arranged to magnetically interact with the first portion in the operational position of the ancillary functional unit.

In a second set of examples, the first portion comprises a permanent magnet and the second portion comprises a ferrous metal element, or the first portion comprises a ferrous metal element and the second portion comprises a permanent magnet.

In a third set of examples, the first and second portions each comprise a permanent magnet.

Thus, there are many different ways to implement the magnet arrangement.

The first and/or the second portion of the magnet arrangement may be covered by means of a coating.

The coating (e.g. epoxy) may be used to improve the corrosion resistance or the tribological characteristics of the magnet arrangement. Magnets are generally fragile (especially permanent neodymium magnets) and it is therefore beneficial to avoid hard impacts, otherwise they may start flaking. In order to avoid this phenomenon, a small plastic coating may thus be used to keep the two parts (i.e. two permanent magnets or one permanent magnet and one ferrous metal element) apart at a predefined distance (e.g. 0.1 mm).

The first portion may comprise a pair of ferrous metal elements and the second portion may comprise a pair of permanent magnets, wherein, in the operational position of the ancillary functional unit, each permanent magnet of said pair of permanent magnets is in a position opposite to a respective one of the ferrous metal elements of said pair of ferrous metal elements for magnetic interaction therewith.

The use of two pairs of ferrous metal elements and magnets provides a stable holding force.

The personal care device is for example an electric shaver, wherein the main functional unit comprises a shaver head. The ancillary functional unit then may comprise a hair trimming unit and the treatment head may then comprise a hair trimmer.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
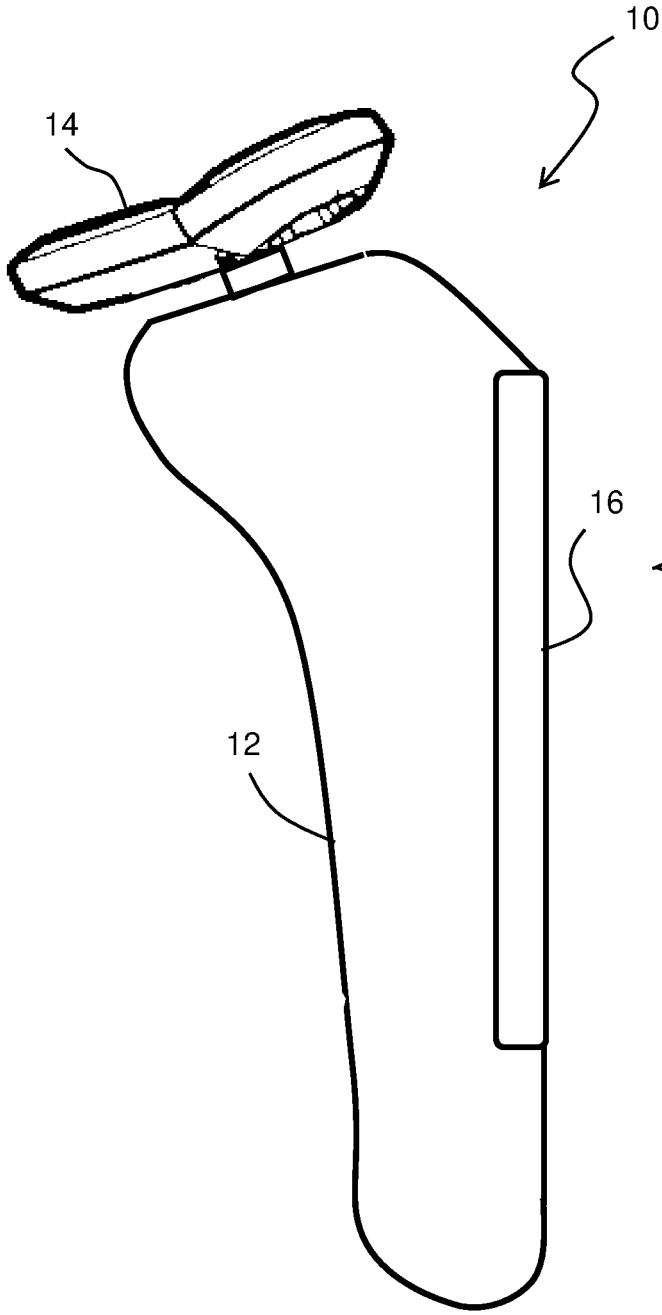
FIG. 1 shows a conventional electric shaver in side view.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a personal care device with a main functional unit and an ancillary functional unit which is displaced from a non-operational position into an operational position and held in the operational position by means of a biasing arrangement. A magnet arrangement is used to exert an additional magnetic holding force on the ancillary functional unit in the operational position. This provides a stable support of the ancillary functional unit in the operational position without requiring a strong biasing arrangement.

The invention will be described with reference to a personal care device in the form of an electric shaver, with a main functional unit in the form of a shaver head and an ancillary functional unit in the form of a hair trimmer module.

FIG. 1 shows a conventional electric shaver 10 in side view.

The shaver comprises a main body 12 and a shaver head 14 supported by the main body 12 at one end thereof. A rear part of the main body 12 houses and supports a hair trimmer module 16. In a non-operational position, the hair trimmer module 16 is recessed into or flush against the rear part of the main body 12, as shown in FIG. 1. Thus, it does not detract from the use of the main functional unit, i.e. the shaver head, of the shaver.

Figure 2:
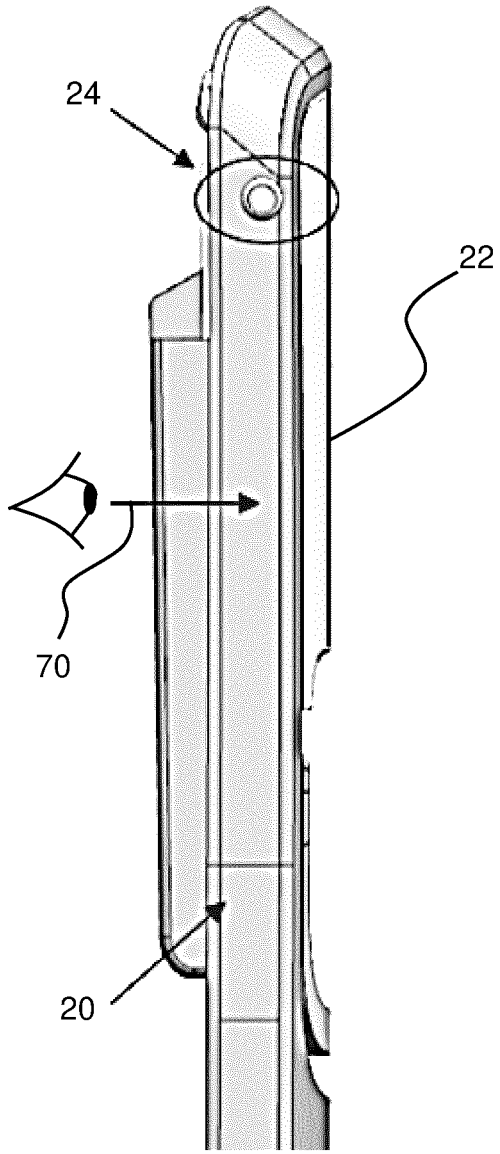
FIG. 2 shows a hair trimmer module of the electric shaver of FIG. 1 in side view.

FIG. 2 shows the hair trimmer module 16 in side view. The hair trimmer module 16 comprises a frame 20 which supports the treatment head, which is in the form of a hair trimmer 22. The frame 20 defines a rotation axis 24 about which the hair trimmer 22 can rotate relative to the frame 20 and the main body 12 from a non-operational retracted position (shown in FIGS. 1 and 2) to an operational deployed position. The frame 20 may be integral with the main body 12 of the shaver or it may be part of a separate module mounted in a fixed position to the main body 12.

Figure 3:
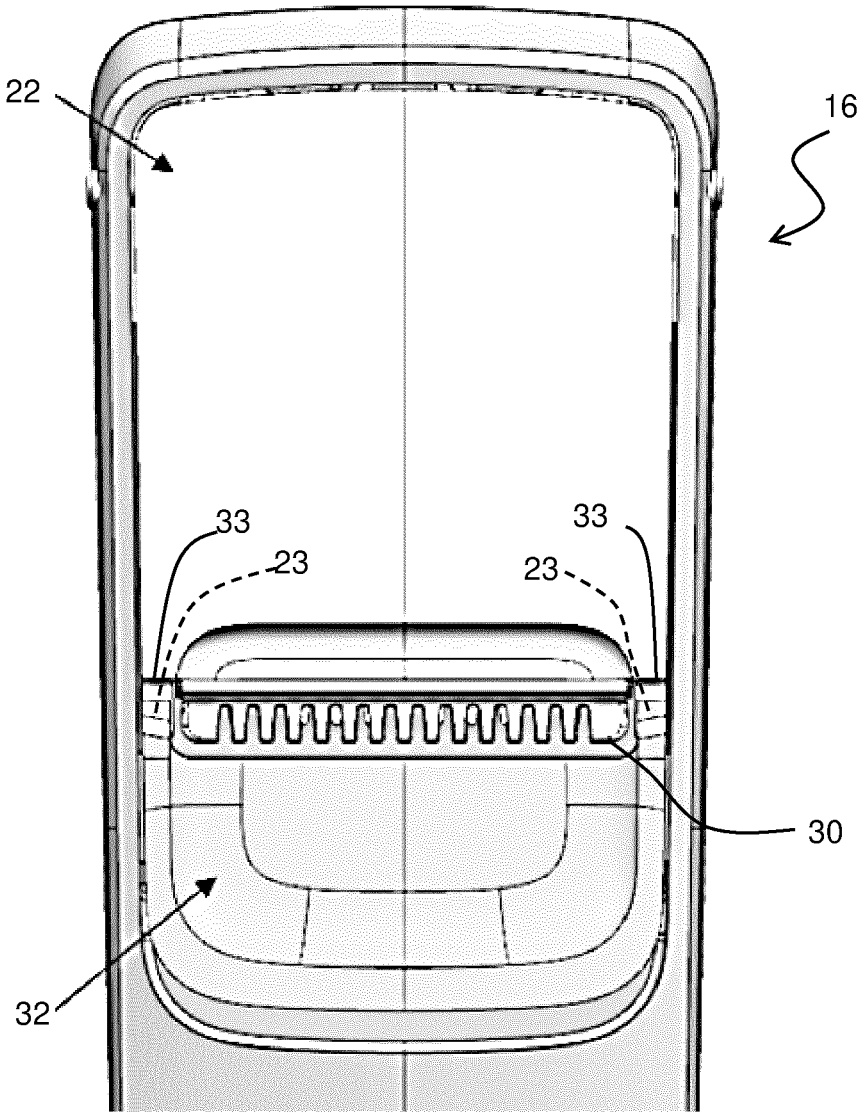
FIG. 3 shows the hair trimmer module of FIG. 2 in plan view.

FIG. 3 shows the hair trimmer module 16 in plan view. The hair trimmer 22 has a cutting head 30 which comprises two overlapping sets of cutting teeth, wherein one of the sets of cutting teeth is driven into a reciprocating motion by means of the shaver motor, and wherein the other set of cutting teeth is stationary. The hair trimmer 22 is held in the non-operational position by a latching mechanism.

Figure 4:
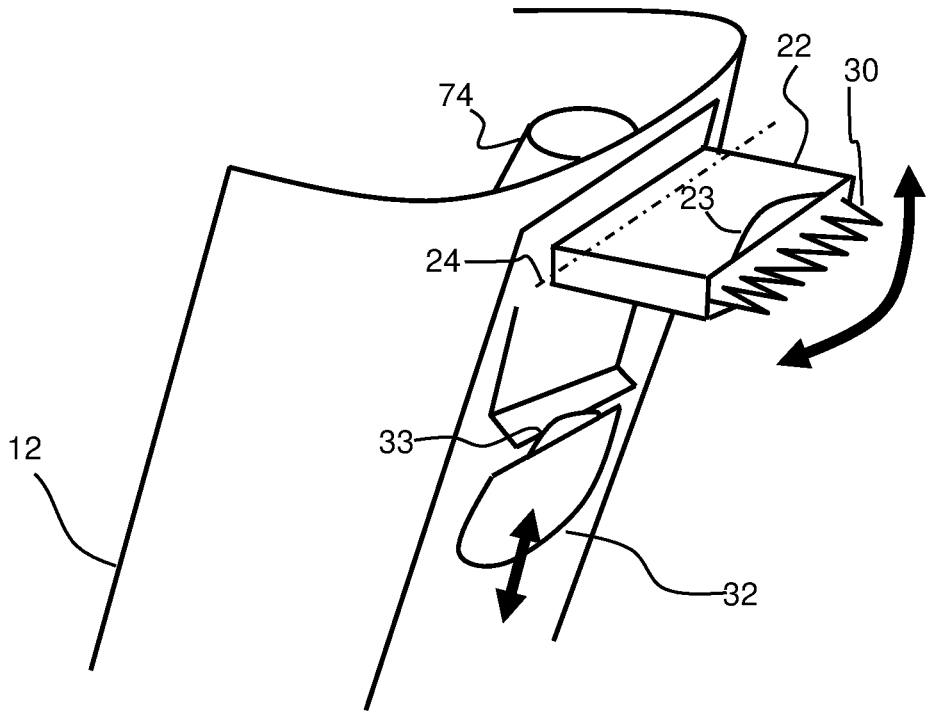
FIG. 4 shows the hair trimmer module of FIG. 2 in a deployed operational position.

As shown schematically in FIG. 4, the latching mechanism comprises a slider 32 and a recess 23 which is provided on the hair trimmer module 16 close to the cutting head 30. In the non-operational position of the hair trimmer module 16, the slider 32 is biased in a direction towards the hair trimmer 22 by means of a slider spring (not shown), so that a rim 33 provided on the slider 32 engages the recess 23 such as to latch the hair trimmer module 16 in the non-operational position. The slider 32 also forms a release mechanism for releasing the latching mechanism. By sliding the slider 32 away from the hair trimmer 22 against the biasing force of the slider spring, i.e. downwardly in the orientation shown in FIGS. 3 and 4, the latching mechanism is released. Thereby, the hair trimmer 22 is enabled to pivot about the rotation axis 24 from the non-operational position into the deployed, operational position under the influence of the biasing force of a biasing element such as a torsion spring (not shown).

FIG. 4 is only schematic. The rim 33 and the recess 23 may in practice be provided at each lateral side of the cutting head 30. As shown in FIG. 3, the rim 33 then may comprise a pair of tabs which each overlap a corresponding recess 23 to hold the hair trimmer module 16 in the non-operational position.

FIG. 4 shows the hair trimmer 22 in the deployed operational position, in which it has been rotated about the pivot axis 24 to open and project outwardly from a rear part of the main body 12.

FIG. 4 also schematically shows a drive coupling 74 by means of which the hair trimmer 22 is coupled to the main motor of the shaver, i.e. the motor that also drives the shaver head.

As explained above, the force required to fold-back the hair trimmer 22 into the non-operational position should be relatively low, so that it is easy for all users to fold back the hair trimmer 22 into the non-operational position. This relatively low fold-back force requires a relatively low biasing force of the biasing element which biases the hair trimmer 22 into the operational position and holds the hair trimmer 22 in the operational position. This low biasing force can result in an instable operational position of the hair trimmer 22, which may give a flimsy impression.

Figure 5:
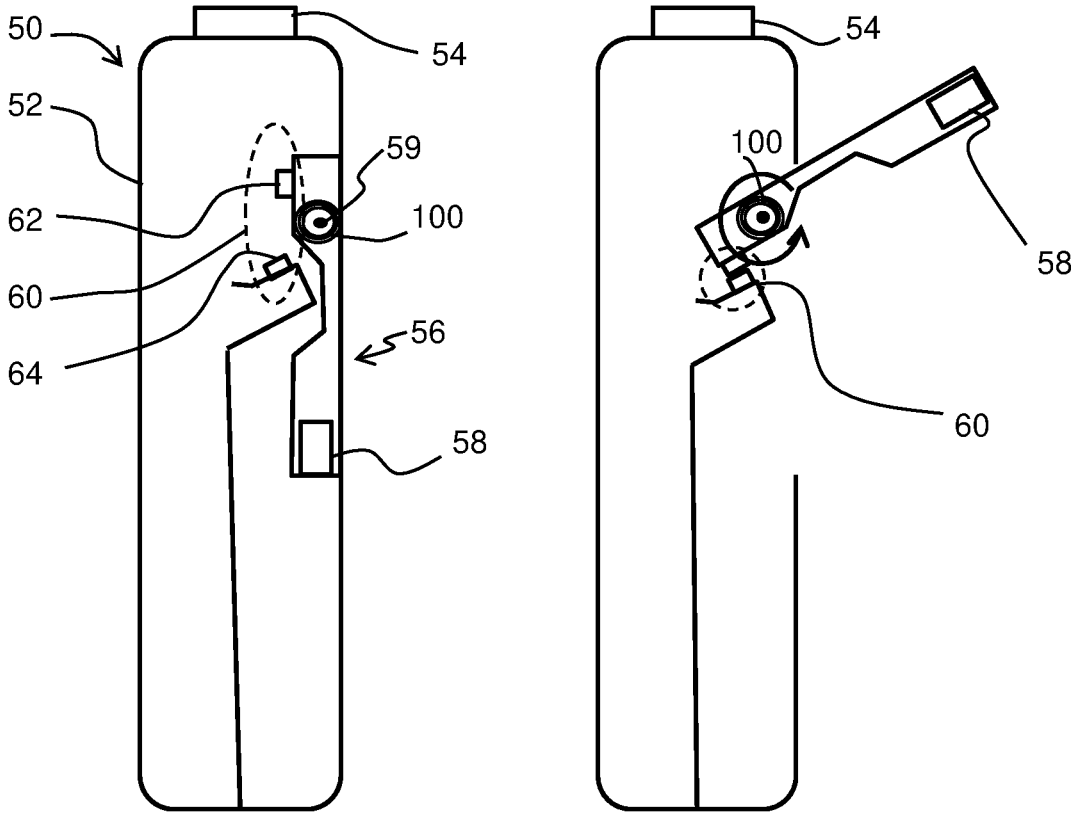
FIG. 5 shows in schematic form one example of a personal care device in accordance with the invention.

FIG. 5 shows in schematic form one example of a personal care device 50 in accordance with the invention, which may be an electric shaver or other type of personal care device. The personal care device 50 comprises a main body 52 and a main functional unit 54 supported by the main body 52. An ancillary functional unit 56 is also supported by the main body and comprises a treatment head 58.

The ancillary functional unit 56 is permanently connected to the main body 52 by a coupling structure 59, shown in this example as a hinge arrangement. The hinge arrangement allows displacement of the ancillary functional unit 56 relative to the main body 52 from a non-operational position to an operational position. The coupling structure 59 also includes a biasing arrangement for driving the ancillary functional unit 56 about the hinge axis 72 (shown in FIG. 6) of the hinge arrangement from the non-operational position (shown in the left of FIG. 5) towards the operational position (shown in the right of FIG. 5). The biasing arrangement comprises a mechanical spring, in particular a torsion spring 100.

The non-operational position shown in the left of FIG. 5 is a retracted position in which the ancillary functional unit 56 is at least partially recessed into the main body 52. The operational position shown in the right of FIG. 5 is an extended position in which the ancillary functional unit 56 projects from the main body 52. Thus, the ancillary functional unit 56 projects outwardly from the main body 52 when in use, but collapses into or against the main body 52 when not in use.

The coupling structure further comprises a magnet arrangement 60 configured to exert, in addition to the biasing force of the biasing arrangement or torsion spring 100, a magnetic holding force on the ancillary functional unit 56 in the operational position of the ancillary functional unit 56, for retaining the ancillary functional unit 56 in the operational position.

The magnet arrangement 60 comprises two portions. A first portion 62 of the magnet arrangement 60 is mounted in a fixed position to the ancillary functional unit 56, and a second portion 64 of the magnet arrangement 60 is mounted in a fixed position to the main body 15. The second portion 64 is arranged to magnetically interact with the first portion 62 in the operational position of the ancillary functional unit 56, as shown in the right of FIG. 5.

The first and second portions 62, 64 may comprise permanent magnets with their opposite poles facing each other in the operational position of the ancillary functional unit 56. Alternatively, one of the first and second portions 62, 64 may be a ferrous metal element and the other of the first and second portions 62, 64 may be a permanent magnet.

The ancillary functional unit 56 of the personal care device 50 is deployed from the main body 52 into the operational position by means of the biasing force of a biasing arrangement. The biasing force of the biasing arrangement also holds the ancillary functional unit 56 in the operational position. To provide a sufficient force to keep the ancillary functional unit 56 in a stable manner in the operational position during use, the magnet arrangement 60 provides an additional magnetic holding force. This avoids the need to increase the force delivered by the biasing arrangement. Thus, the biasing arrangement only needs to provide sufficient force to move the ancillary functional unit 56 from the non-operational position into the operational position. The biasing arrangement can thus be small, compact and of low cost.

Figure 6:
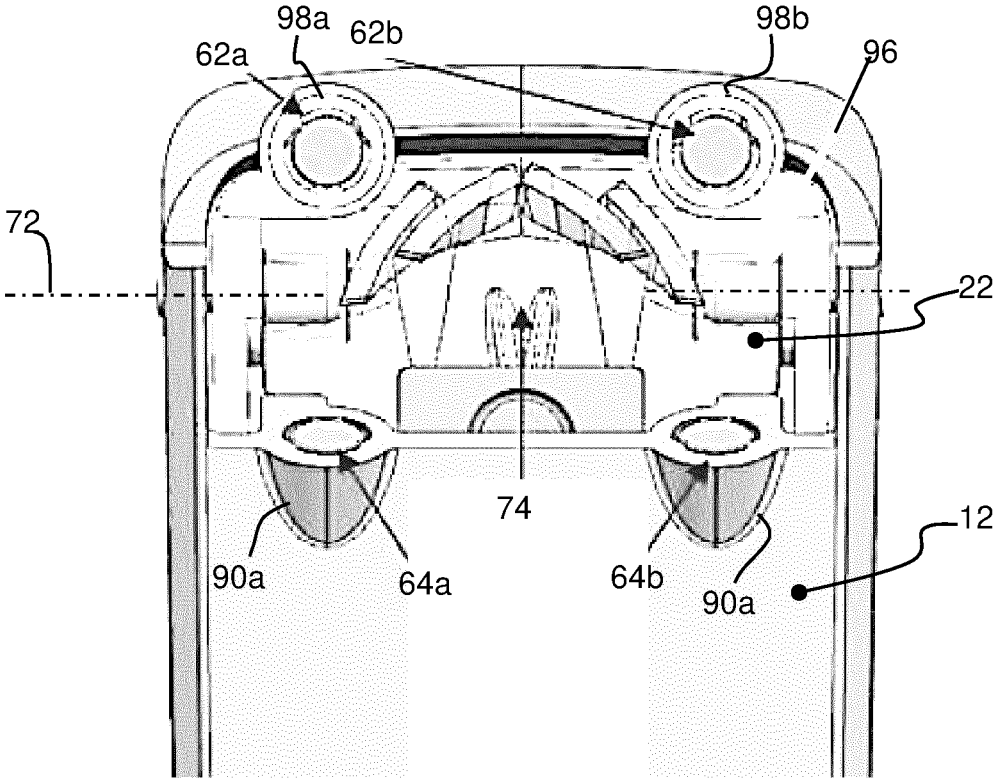
FIG. 6 shows an implementation of the device of FIG. 5 for an electric shaver of the general type explained with reference to FIGS. 1 to 4.

FIG. 6 shows an implementation of the arrangement of FIG. 5 in an electric shaver of the general type explained with reference to FIGS. 1 to 4. The same reference numerals are used as in FIGS. 1 to 4 when referring to elements already discussed with reference to those figures.

FIG. 6 shows a view from the inside of the hair trimmer module 16 looking in the direction represented by arrow 70 in FIG. 2. The hair trimmer 22 is in the non-operational position.

The magnet arrangement comprises first elements 62*a*, 62*b* and second elements 64*a*, 64*b*. The first and second elements 62*a*, 64*a* form a first pair and the first and second elements 62*b*, 64*b* form a second pair.

The first elements 62*a*, 62*b* are mounted in fixed positions on a supporting member 96 of the hair trimmer module 16, in positions offset from the rotation axis 72 of the hair trimmer module 16. The supporting member 96 also permanently supports the hair trimmer 22. The second elements 64*a*, 64*b* are mounted in fixed positions on an internal part of the main body 12 back of the hair trimmer module 16, also in positions offset from the rotation axis 72. Rotation of the supporting portion 96 about the axis 72, from the non-operational position into the operational position, brings the pair of first elements 62*a*, 62*b* into alignment with the pair of second elements 64*a*, 64*b*. In this example, the first elements 62*a*, 62*b* are ferrous metal elements and the second elements 64*a*, 64*b* are permanent magnets. Thus, in the operational position of the hair trimmer module 16, each permanent magnet of the pair of second elements 64*a*, 64*b* is in a position opposite to a respective one of the ferrous metal elements of the pair of first elements 62*a*, 62*b* for magnetic interaction therewith, so that the magnet arrangement exerts the magnetic holding force on the supporting member 96.

The first elements 62*a*, 62*b* and/or the second elements 64*a*, 64*b* may be covered by means of a coating, for example a plastic coating, to avoid any metal on metal contact.

FIG. 6 also shows a driven coupling member 74 of the hair trimmer module 16. The driven coupling member 74 is coupled to the reciprocating set of cutting teeth of the cutting head 30. In the operational position of the hair trimmer module 16, the driven coupling member 74 engages with a driving coupling member (nor shown) which is accommodated in the main body 12 and is coupled to the motor of the electric shaver.

Figure 7:
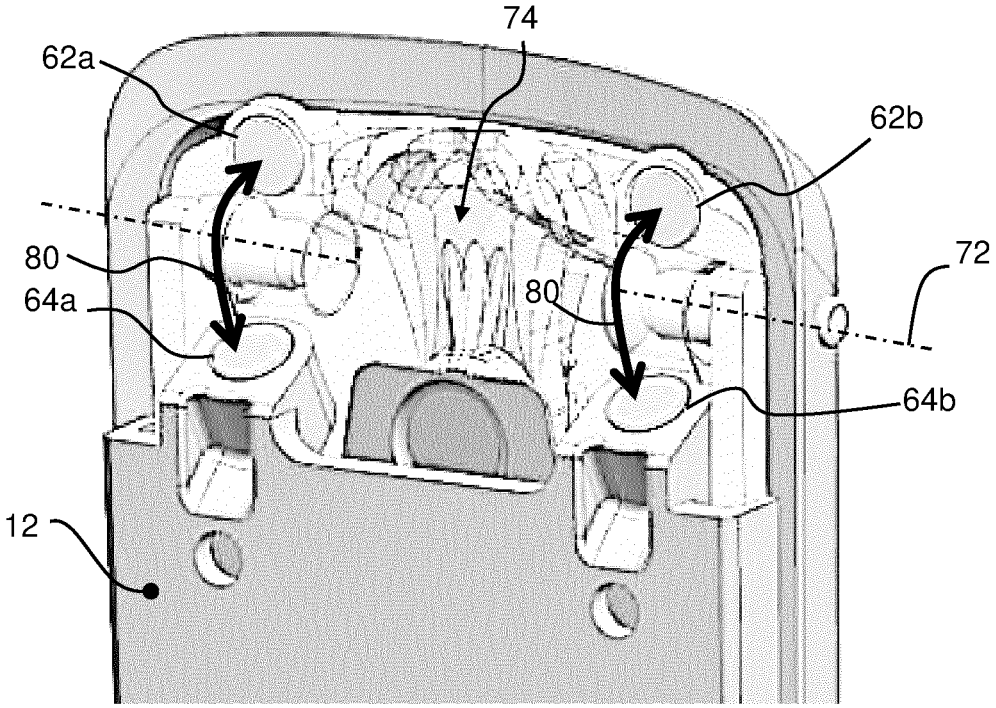
FIG. 7 shows a perspective view from the same general direction as FIG. 6.

FIG. 7 shows a perspective view from the same general direction as FIG. 6. In this Figure, arrows 80 represent the movement of the first elements 62*a*, 62*b* towards the second elements 64*a*, 64*b* when the hair trimmer module pivots about the axis 72 from the non-operational position to the operational position.

Figure 8:
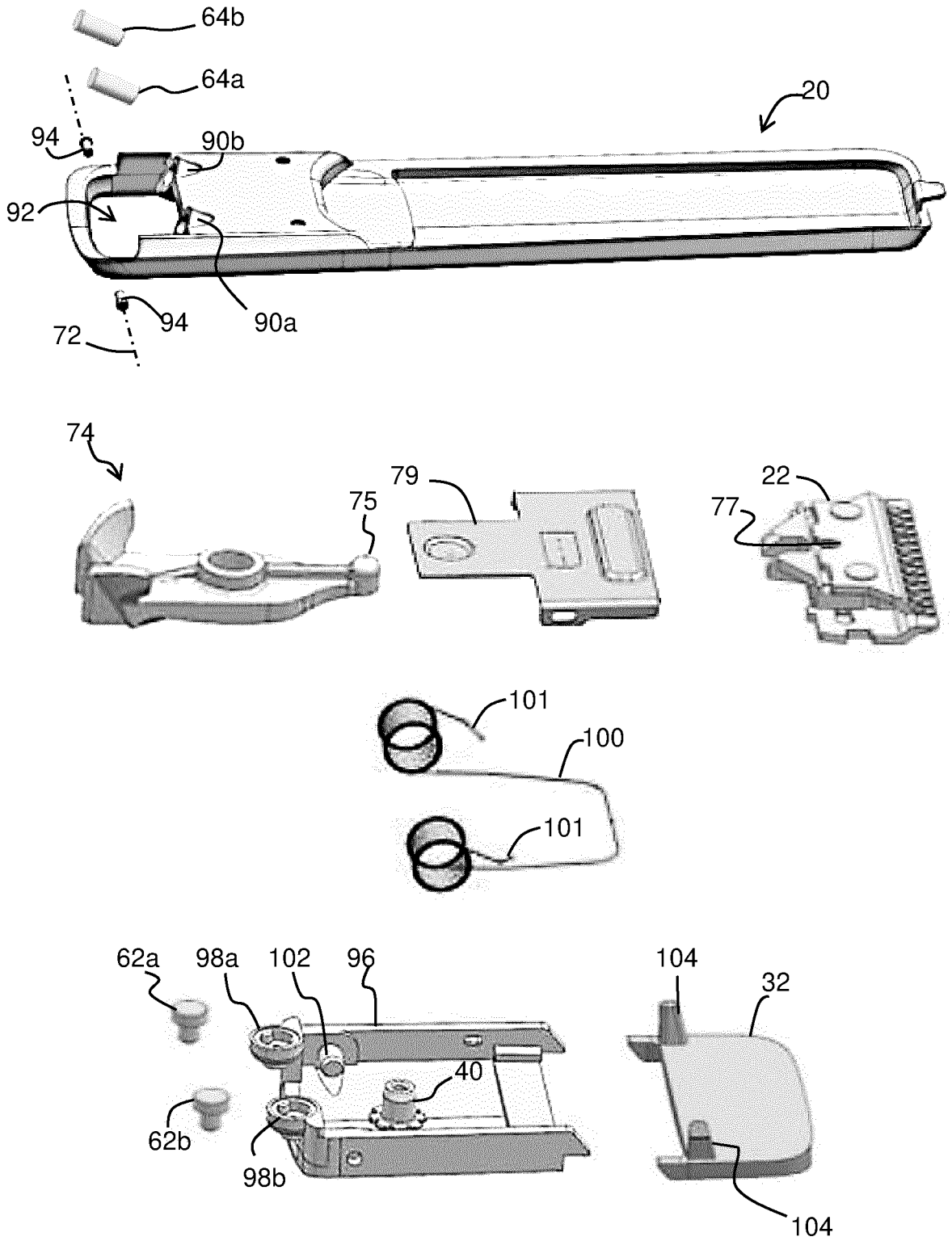
FIG. 8 shows an exploded view of the components of a hair trimmer module of the device of FIG. 5.

FIG. 8 shows an exploded view of the components of the hair trimmer module 16.

The hair trimmer module 16 comprises the frame 20 which is mounted to the main body 12. The second elements 64*a*, 64*b* (the permanent magnets) are fitted, for example by a glue, into mounting holes 90*a*, 90*b* provided in the frame 20. The frame 20 has an opening 92 for receiving the supporting member 96 with the hair trimmer 22 supported thereby. A pair of pins 94 define the rotation axis 72 about which the supporting member 96 is pivotable relative to the frame 20 and the main body 12.

In order to improve the assembly, it is possible to overmold the permanent magnets 64*a*, 64*b* into the plastic material of the frame 20. A particular magnetic alloy may be needed in this case.

The supporting member 96 is configured to permanently support the hair trimmer 22. The first elements 62*a*, 62*b* are mounted in mounting holes 98*a*, 98*b* provided in the supporting member 96.

The biasing arrangement in the form of the torsion spring 100 is fitted to the supporting member 96 using bosses 102 provided on the supporting member 96. A loop 101 of the torsion spring 100 is connected to the supporting member 96 to exert the biasing force on the supporting member 96.

FIG. 8 also shows the driven coupling member 74, which is rotationally supported by a bearing 40 provided on the supporting member 96. The driven coupling member 74 is coupled to the reciprocating set of cutting teeth of the hair trimmer 22 via coupling elements 75, 77 provided on, respectively, the driven coupling member 74 and the hair trimmer 22. Reference 79 represents a guiding and mounting member onto which the two sets of cutting teeth of the hair trimmer 22 are mounted. The guiding and mounting member 79 is also supported by the supporting member 96.

FIG. 8 further shows the slider 32 which is linearly guided relative to the frame 20 by means of two guiding elements 104.

The magnet arrangement is used to keep the hair trimmer module 16 (or more generally, any ancillary functional unit) more firmly and stable in its operational position. The solution is compact, and enables stable operation of the ancillary functional unit, e.g. trimming of the sideburns. Once deployed, the ancillary functional unit is able to remain in position and withstand external forces applied at its extremity without noticeable motion relative to the main body, for example of at least 1N. The magnetic force is local in nature in that, once the force threshold is reached to separate the magnetically coupled elements and the ancillary functional unit has been moved out of the operational position over a small distance, the ancillary functional unit can be further moved into the non-operational position with ease because the user only needs to push against the relatively low biasing force of the biasing arrangement.

As mentioned above, there are various options for the magnet arrangement. The elements (magnets or ferrous elements) may be cylindrical or may have other shapes, such as rectangular.

The example shown has two pairs of elements (e.g. two magnets and two ferrous metal pins). The use of magnets for all elements may enable smaller elements to be used, but they must then be oriented correctly.

The elements of the magnet arrangement may employ a magnet inserted in a ferromagnetic structure, with a ferrous metal cap, such as a metal washer, closing the system.

As is clear from the examples above, the invention is of particular interest to electric shavers with a pop-up trimmer. However, the invention may be applied generally to personal care devices. Examples are shaving, brushing, epilating, hair trimming, and skin abrading devices. The ancillary functional unit may also have a different function then a trimming function, such as brushing or skin abrading.

As mentioned above, in the operational position of the ancillary functional unit a small gap may be provided between the permanent magnet and the ferrous metal element or between the pair of permanent magnets, for example a minimum gap of 0.1 mm. The gap may be filled by a plastic material in the form of a coating provided on the permanent magnet or on one of the permanent magnets. The magnetic force of the magnet arrangement is reduced as a result of said gap. The size of the gap may be accurately designed to achieve a desired magnetic force of the magnet arrangement.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

The mere fact that certain measures are recited in mutually different dependent claims does not indicate that a combination of these measures cannot be used to advantage.

If the term "adapted to" is used in the claims or description, it is noted the term "adapted to" is intended to be equivalent to the term "configured to".

Any reference signs in the claims should not be construed as limiting the scope.

The invention claimed is:

1. A personal care device comprising:

a main body;

a main functional unit supported by the main body;

an ancillary functional unit supported by the main body and comprising a treatment head; and a coupling structure that permanently connects the ancillary functional unit to the main body, wherein the coupling structure:

is configured to allow displacement of the ancillary functional unit relative to the main body from a non-operational position to an operational position; and comprises a biasing arrangement configured to exert a biasing force on the ancillary functional unit to displace the ancillary functional unit from the non-operational position towards the operational position and to hold the ancillary functional unit in the operational position, comprises a magnet arrangement configured to exert, in addition to the biasing force of the biasing arrangement, a magnetic holding force on the ancillary functional unit in the operational position of the ancillary functional unit, for retaining the ancillary functional unit in the operational position.

2. The personal care device as claimed in claim 1, wherein the coupling structure defines a pivotal axis about which the ancillary functional unit is rotatable relative to the main body from the non-operational position to the operational position.

3. The personal care device as claimed in claim 1, wherein the non-operational position is a retracted position in which the ancillary functional unit is at least partially recessed into the main body, and wherein the operational position is an extended position in which the ancillary functional unit projects from the main body.

4. The personal care device as claimed in claim 1, wherein the ancillary functional unit comprises a supporting member configured to permanently support the treatment head, and wherein the magnet arrangement is configured to exert the magnetic holding force on the supporting member.

5. The personal care device as claimed in claim 1, wherein the coupling structure comprises:

a latching mechanism configured to latch the ancillary functional unit in the non-operational position; and a release mechanism configured to release the latching mechanism such that the ancillary functional unit is enabled to be displaced from the non-operational position to the operational position by the biasing force of the biasing arrangement.

6. The personal care device as claimed in claim 1, wherein the biasing arrangement comprises a mechanical spring.

7. The personal care device as claimed in claim 1, wherein the magnet arrangement comprises a first portion mounted to the ancillary functional unit and a second portion mounted to the main body and arranged to magnetically interact with the first portion in the operational position of the ancillary functional unit.

8. The personal care device as claimed in claim 7, wherein:

the first portion comprises a permanent magnet and the second portion comprises a ferrous metal element; or the first portion comprises a ferrous metal element and the second portion comprises a permanent magnet.

9. The personal care device as claimed in claim 7, wherein the first and second portions each comprise a permanent magnet.

10. The personal care device as claimed in claim 7, wherein the first and/or the second portion is/are covered by a coating.

11. The personal care device as claimed in claim 7, wherein the first portion comprises a pair of ferrous metal elements and the second portion comprises a pair of permanent magnets, wherein, in the operational position of the ancillary functional unit, each permanent magnet of said pair of permanent magnets is in a position opposite to a respective one of the ferrous metal elements of said pair of ferrous metal elements for magnetic interaction therewith.

12. The personal care device as claimed in claim 1, wherein the personal care device is an electric shaver, and wherein the main functional unit comprises a shaver head.

13. The personal care device as claimed in claim 12, wherein the ancillary functional unit comprises a hair trimming unit and the treatment head comprises a hair trimmer.

* * * * *